US006042258A

United States Patent [19]

Hines et al.

[11] Patent Number: 6,042,258

[45] Date of Patent: Mar. 28, 2000

[54] ADMIXTURE DISPENSING AND CONCRETE MIXER MONITORING METHOD

[75] Inventors: Kelly Hines, Spruce Grove; Michael Whitehead, Edmonton, both of Canada

[73] Assignee: MBT Holding AG, Zurich, Switzerland

[21] Appl. No.: 08/949,814

[22] Filed: Oct. 14, 1997

Related U.S. Application Data

[63] Continuation-in-part of application No. 08/690,678, Jul. 31, 1996, abandoned.

[51] Int. Cl.[7] ..... B28C 7/12

[52] U.S. Cl. ..... 366/8

[58] Field of Search ..... 366/1, 2, 6, 8, 366/16–19, 30, 33, 132, 140, 151.1, 34, 152.1, 182.1, 348, 349; 364/528, 528.1, 528.18

[56] References Cited

U.S. PATENT DOCUMENTS

| | | | |
|---|---|---|---|
| 3,186,596 | 6/1965 | Badgett . | |
| 3,596,759 | 8/1971 | King et al. . | |
| 3,997,434 | 12/1976 | Macauley, Jr. . | |
| 4,003,431 | 1/1977 | Novotny et al. . | |
| 4,226,542 | 10/1980 | Black et al. | 366/17 |
| 4,318,177 | 3/1982 | Rapp et al. . | |
| 4,488,815 | 12/1984 | Black | 366/17 |
| 4,964,917 | 10/1990 | Brobrowski et al. . | |
| 5,113,350 | 5/1992 | Sargent . | |
| 5,127,740 | 7/1992 | DeBoer | 366/2 |
| 5,203,919 | 4/1993 | Brobrowski et al. . | |
| 5,244,498 | 9/1993 | Steinke . | |
| 5,268,111 | 12/1993 | Metz et al. . | |
| 5,332,366 | 7/1994 | Anderson . | |
| 5,427,617 | 6/1995 | Bobrowski et al. . | |
| 5,653,533 | 8/1997 | Green | 366/16 |
| 5,695,280 | 12/1997 | Baker et al. | 366/17 |

FOREIGN PATENT DOCUMENTS

| | | | |
|---|---|---|---|
| 467086 | 1/1992 | European Pat. Off. | 366/2 |
| 2732263 A3 | 10/1996 | France . | |
| 4001652 A1 | 8/1991 | Germany . | |
| 195 18 469 A1 | 11/1996 | Germany . | |
| 2293664 | 4/1996 | United Kingdom . | |
| WO 86/06677 A1 | 11/1986 | WIPO . | |

OTHER PUBLICATIONS

"Stabilization of Returned Plastic Concrete", by Master Builders Technologies, Nov., 1990, U.S.A.

"Delvo System", by Master Builders Technologies, Nov., 1990, U.S.A.

"Stabilization of concrete Wash Water", by Master Builders Technologies, Dec., 1990, U.S.A.

"Long Haul Stabilization of Ready–Mixed Concrete Delvo System Application", by Master Builders Technologies, Jul., 1991, U.S.A.

"Delvo Stabilizer", by Master Builders Technologies, Apr., 1994, U.S.A.

Patent Abstracts of Japan, Publication No. 01045605, Feb. 20, 1989.

*Primary Examiner*—Charles E. Cooley

*Attorney, Agent, or Firm*—Renner, Kenner, Greive, Bobak, Taylor & Weber

[57] ABSTRACT

An admixture dispensing and concrete mixer monitoring system which determines the correct amount of admixture, such as a stabilizer, to dispense in a load of unused concrete or for washing out a concrete mixer includes an admixture dispensing unit linked to a computer system. The computer system includes a processor which controls and monitors the operation of the dispensing unit which includes an admixture piping system and a water piping system. The processor is linked to various pumps, meters and valves in the admixture and water piping systems to control the flow of admixture and water into the concrete mixer. Additionally, the computer system provides questions and prompts to the user to assist in accurately and quickly determining the correct amount of admixture to deposit in the concrete mixer. The computer system also allows the tracking of multiple delivery or mixing trucks and their content status at multiple mixing plants to assist in the scheduling thereof.

21 Claims, 3 Drawing Sheets

Cement
Sand
Gravel
Water
INDICIA
Admixture
Water

ADMIXTURE DISPENSING AND CONCRETE MIXER MONITORING METHOD

This application is a continuation-in-part of application Ser. No. 08/690,678 filed on Jul. 31, 1996 now abandoned.

TECHNICAL FIELD OF THE INVENTION

The present invention is directed to a system for monitoring the content status of concrete mixers for determining the nature and amount of admixture that needs to be included with the other concrete ingredients. More particularly, the present invention is directed to a system which determines how much hydration stabilizer and/or activator needs to be added to a batch of new or reclaimed concrete and controls the dispensing of the same.

BACKGROUND OF THE INVENTION

As known in the art, an admixture is a material other than hydraulic cement, water and aggregate that is used as an ingredient of concrete or mortar and is added to the batch immediately before, during or after its mixing. Admixtures are used to modify the properties of the concrete in such a way as to make it more suitable for a particular purpose or for economy. Thus, the major reasons for using admixtures are (1) to achieve certain structural improvements in the resulting cured concrete; (2) to improve the quality of concrete through the successive stages of mixing, transporting, placing, and curing during adverse weather or traffic conditions; (3) to overcome certain emergencies during concreting operations; and (4) to reduce the cost of concrete construction. In some instances, the desired result can only be achieved by the use of an admixture. In addition, using an admixture allows the employment of less expensive construction methods or designs and thereby offsets the costs of the admixture.

For one example of an application of an admixture for use in concrete, at the end of a delivery, concrete mixers may contain from 200 to 600 pounds of residual cement, sand or rock. When left in the mixer overnight, the residual concrete will settle and harden in the bottom of the mixer. While the residual materials can be washed out of the mixer with a large amount of water, disposal of the liquid may cause an environmental problem, particularly in large metropolitan areas. To avoid this problem, it is desirable to stabilize the setting of residual concrete in a mixer so that it remains fluid and the residual material can still be used the next day. It is also desirable to be able to stabilize the setting of concrete in a mobile mixer while the mixer is being transported to another location. For specific applications, it may also be desirable to stabilize the setting of concrete for a specific length of time, during breakdown or delay in traffic in populated areas. The addition of retarding admixture to the concrete is used to solve each of these problems. By varying the amounts of a retarding admixture used in a batch, the setting of the concrete can be delayed for a selected time period.

A stabilizer completely inhibits the setting formation of concrete for a predetermined period of time depending upon the amount of stabilizer added. A stabilizer is defined as an admixture that stops or slows down the hydration process of both silicate and aluminate phases of Portland cement; causes a controlled decrease of the rate of hydration of hydraulic cement, and lengthens the time of setting in both freshly batched concrete for long hauls and returned concrete for reuse; and stops the hydration of cement in wash-water allowing it to be reused the next day. As such, a stabilizer stops the cement hydration process, whereas a retarder delays the concrete setting process. Along with the aforementioned advantages, stabilizers also provide improved workability, reduced segregation, superior finishing characteristics, flexibility in scheduling placing and finishing operations, elimination of cold joints and reductions in thermal cracking. Use of a stabilizer also reduces or eliminates the need for portable batch plants necessary to service long distance jobs. When mixed with plastic concrete, the stabilizer stops cement hydration by forming a protective barrier around cementitious particles. This barrier prevents portland cement, fly ash and granulated slag from achieving initial set. Such a stabilizer is currently sold under the tradename DELVO by Master Builders, Inc., Cleveland, Ohio, the assignee of the present invention.

The amount of stabilizer to be added to a batch of concrete is determined by numerous factors. These factors include, but are not limited to, the amount and temperature of the concrete, the amount of accelerant and retarder added to the concrete and the age of the concrete. Stabilizers may be used for the stabilization of unused concrete returned from a job site, stabilization of concrete that must travel extended distances to a job site and for "washing-out" any residue contained in empty trucks which may then be used in a new batch of concrete. To return the stabilized concrete to its normal setting condition, an activator may be added to the concrete batch. Thus, if a batch of stabilized concrete is delivered to a job site with another two hours remaining in the stabilization period, an activator may be added to begin the concrete setting process immediately.

Difficulties arise in the use of stabilizers due to their precise quantity requirements. These difficulties are primarily attributable to the various factors that must be considered. These factors include, but are not limited to, the other chemical admixtures, concrete materials and mix designs used; the elapsed time from initial batching; the returned plastic concrete temperature; the quantity of concrete being treated; and the stabilization time required. In the past, charts with the various factors were employed to determine the amount of stabilizer to mix with the concrete. For example, if unused, returned plain concrete is to be used that same day, the batchman must first determine the temperature of the concrete and how much accelerator or retarder has been added. Next, the batchman must determine the age of the unused concrete within the half-hour. Usually, concrete older than 3.5 hours cannot be treated. Next, the batchman must determine for how long the treated concrete is to be stabilized. Based on these factors a stabilizer amount is determined for a given quantity of concrete. The calculated amount of stabilizer then is added and mixed for 5–7 minutes.

Unfortunately, the aforementioned charts may be misread or, alternatively provide exaggerated quantity amounts if an improper factor value is used. If too little stabilizer is mixed with a batch of concrete it begins to set before arriving at a job site, making the concrete unusable. If too much stabilizer is added, the setting process is delayed and interferes with construction schedules and the like. As a result, concrete mixers and suppliers are dissatisfied with the performance of stabilizers and may be disinclined to use them.

As seen above, the successful use of admixtures depends upon the accuracy with which they are prepared and batched. Batching means the weighing or volumetric measuring of the ingredients for a batch of either concrete or mortar and introducing them into the mixer. The amount of admixture added during batching must be carefully controlled. Inaccuracies in the amount of admixture added can significantly affect the properties and performance of the concrete being batched and even defeat the original purpose of including the admixture. The need for accuracy in measuring the amount of solid or even liquid admixture to be added to a batch is particularly acute where only a relatively small amount of admixture is required for the job. Accordingly, it is desirable to have a system and related method of dispersing admixture which is accurate, saves time and optimizes the reclamation of unused concrete for a fleet of mixer trucks.

U.S. Pat. Nos. 4,964,917; 5,203,919; and 5,427,617 to Bobrowski et al, which are assigned to the assignee of the present invention, disclose methods and compositions for reclaiming and stabilizing concrete with the use of hydration retarding agents, stabilizing agents and acceleration agents. The concrete is reclaimed by retarding or stabilizing the hydration of the unused portion returned from a job site by adding a retarding or stabilizing agent and at the end of the retardation period, diluting the retarded concrete with fresh concrete. Factors such as time, temperature, the type of new concrete, the type of returned concrete and the like are considered in determining how to treat the unused concrete.

U.S. Pat. No. 5,268,111 to Metz et al discloses a concrete reclamation system with a mixing agitator. The unused concrete is placed in a receiving tank with diluting solution of water. After thorough mixing, the sand and aggregate components of the concrete settle into a first layer and the cement solids and a fines portion of the sand settle into a second water-mixture layer. The layers are then separated and conveyed to respective storage areas for later use. The disclosures of U.S. Pat. Nos. 4,964,917; 5,203,919; 5,427,617; and, 5,268,111 are incorporated herein as if fully written out below.

Although the above noted patents describe methods to reclaim and stabilize concrete, the difficulties involved with using stabilizers and other admixtures present certain disadvantages. In particular, the patent to Metz et al employs a cumbersome aggregate separation system that is simply not required by use of the present invention. The industry does not currently have a system for calculating the precise amount of admixture to be added for new or unused concrete. Nor is it known to precisely control the dispensing of the admixture, such as stabilizers, with the same system. Another deficiency of the known art is that no known system can manage an entire fleet of concrete mixing trucks with respect to the deposition of admixtures, on site or remotely, to ensure that trucks with unused concrete are reclaimed prior to using empty trucks.

Other difficulties which are not addressed by the above patents include the generation of reports related to the status of the mixing trucks, how much concrete is saved by using the system, and the like. Also, the ease of determining and dispensing the appropriate admixtures are not addressed by the above patents.

It is therefore an object of the present invention to provide an admixture dispensing and concrete mixer monitoring system for monitoring the content status of concrete mixers. Another object of the present invention is to provide a system for easily determining the nature and amount of admixture that needs to be included with the other concrete ingredients and controlling the dispensing of the same, which streamlines the efficient use of a fleet of delivery trucks and saves time and material costs in the manufacture of concrete.

SUMMARY OF THE INVENTION

The present invention provides for the input of variables to determine the amount of admixture to be dispensed by a control system into a particular concrete mixer, such as a concrete mixing truck or stationary mixer. The variables may include the amount of unused concrete in a mixer, the temperature of the unused concrete, the amount of concrete to be added to the mixer, the type of cement in the unused and/or new concretes, the temperature of the new concrete and the amount of time the new batch of concrete is to be in transit, to name a few. The control system then dispenses the calculated amount of admixture into the mixer for mixing. The control system may also be employed to monitor and track a fleet of concrete mixing and/or delivery trucks on site or at remote locations, to generate various reports on the activity of the fleet and particular trucks and to be integrally connected with a main computer system for issuing invoices, maintaining inventory and the like.

It should be noted that the terms "delivery truck" or "mixing truck" are encompassed by not only mixing trucks to which the basic ingredients are added and the concrete actually mixed, but also to agitation trucks whose function is to purely agitate a concrete mix prepared in a stationary plant mixer, a practice which is common in, for example, Japan. Although the invention is described with reference to the mixing truck system (as opposed to the plant mixing/agitating truck system), the skilled person will readily perceive how the system can be adapted to the latter system.

The present invention provides a concrete mixer monitoring and dispensing system, comprising: means for providing a plurality of concrete ingredient supplies comprising at least a supply of admixture, said plurality of concrete ingredient supplies deliverable to a concrete mixer; means for measuring said supply of admixture delivered to the concrete mixer; valve means for controlling the flow of said supply of admixture to the concrete mixer; and processor means for receiving concrete mixing information, calculating a quantity of admixture to be delivered to the concrete mixer, opening said valve means, monitoring said measuring means, and closing said valve means when said measuring means determines that the desired amount of said supply of admixture has been deposited in the concrete mixer.

The present invention further provides a method for monitoring at least one concrete mixing or delivery truck and its contents, comprising the steps of: determining the content status of at least one of a fleet of concrete mixing or delivery trucks and when the at least one concrete mixing or delivery truck is to be delivered at a job site; calculating a quantity of admixture depending upon the findings of said determining step; and depositing said quantity of admixture into the at least one concrete mixing or delivery truck.

The present invention also provides a process for determining an amount of admixture to be dispensed in a concrete mixing or delivery truck included in a fleet of concrete mixing or delivery trucks, comprising the steps of: storing in look-up tables data for determining admixture quantities to be dispensed; storing in memory input questions to be answered by a user; processing by a processor the answers provided by the user to select which stored look-up table to access to determine admixture quantities; and calculating a quantity of admixture from said selected look-up table and the answers provided by the user.

DETAILED DESCRIPTION OF THE INVENTION

Figure 1:
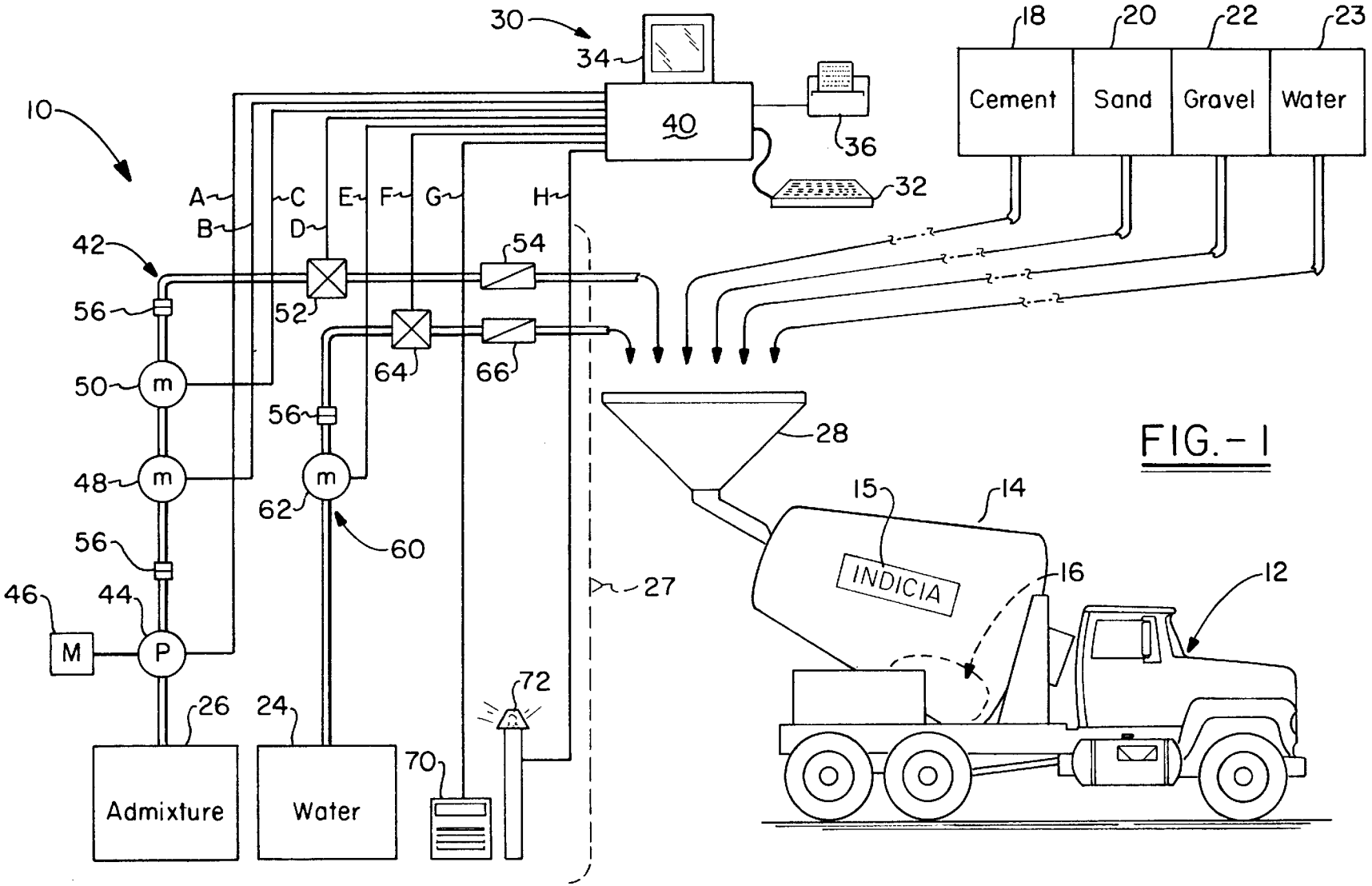
FIG. 1 is a schematic drawing of the concrete mixer monitoring and control system according to the present invention. By way of example, a concrete mixing truck is used as the mixer.

Referring now to the drawings and more particularly to FIG. 1, it can be seen that a concrete dispensing and mixer monitoring system according to the invention is designated generally by the numeral 10. Generally, the system 10, with input from a user, determines whether a concrete mixing or delivery truck is going to or returning from a job site, whether the concrete mixing or delivery truck carries any unused concrete leftover from a previously visited job site, when the concrete mixing truck will be returned to service and accordingly how much admixture, and in particular a stabilizer, should be deposited in the concrete mixing truck. Such a system would typically be used where concrete is mixed or "batched," either on site or remotely. The system 10 may also be used by itself for demonstration of the system's capabilities or for when the system is not connected to an admixture dispenser and the admixture is deposited manually.

The system is also applicable to stationary mixers in which the basic ingredients and the admixture are mixed in an external stationary mixer and then transferred to a delivery truck for ultimate delivery to the job site. The function of the delivery truck in this embodiment is to agitate the concrete mix while en route to the job site. This is different than the true mixing truck set-up. A mixing truck has the basic ingredients and the admixture added to it, and these ingredients are actually mixed within the truck's internal mixing tank en route to the job site. Thus in this latter scenario, the truck is a combination mixer and delivery truck.

Further description of the invention below is described with regard to a mixing truck. However, one skilled in the art can understand the invention is fully operable with a combination mixing and delivery truck or an agitation truck as described above. For purposes of the specification and claims, "mixing truck" as used herein shall include either combination mixing and delivery trucks or agitation trucks. Further, except as distinguished herein, for purposes of the specification and claims, "mixer" shall include either stationary mixers or mixing trucks.

Some admixtures are used to modify the fluid properties of fresh concrete, mortar and grout, while others are used to modify hardened concrete, mortar, and grout. The various admixtures used in the present invention are materials that can be used in concrete mortar or grout for the following purposes: (1) to increase workability without increasing water content or to decrease the water content at the same workability: (2) to retard or accelerate the time of initial setting; (3) to reduce or prevent settlement of the finished material or to create slight expansion thereof; (4) to modify the rate and/or capacity for bleeding; (5) to reduce segregation of constituent ingredients; (6) to improve penetration and pumpability; (7) to reduce the rate of slump loss; (8) to retard or reduce heat evolution during early hardening; (9) to accelerate the rate of strength development at early stages; (10) to increase the strength of the finished material (compressive, tensile, or flexural); (11) to increase durability or resistance to severe conditions of atmospheric exposure, including application of deicing salts; (12) to decrease the capillary flow of water within the material; (13) to decrease permeability of the material to liquids; (14) to control expansion caused by the reaction of alkali with certain aggregate constituents; (15) to produce cellular concrete; (16) to increase the bonding of concrete to steel reinforcing elements; (17) to increase the bonding between old and new concrete; (18) to improve the impact resistance and abrasion resistance of finished materials; (19) to inhibit the corrosion of embedded metal; (20) to produce colored concrete or mortar; (21) to introduce natural or synthetic fibers to reinforce concrete; and (23) to stabilize or inhibit the concrete setting process.

The system 10 includes a concrete mixing truck 12 with a mixing tank 14 which is adapted to rotate and mix the concrete aggregate and appropriate additives. The truck 12 is part of a fleet of concrete mixing trucks and as such may be identified with a unique number or indicia 15. This indicia may be permanently marked on the truck 12 or may be carried by a transponder that communicates with an appropriate receiver. The truck 12 may carry a portion of unused, previously mixed concrete 16. The mixing tank 14 receives bulk concrete ingredients such as cement 18, sand 20, gravel 22 and water 23. A supply of water 24 and a supply of admixture 26 are deposited in the mixing tank 14 by a dispensing system 27. These ingredients or materials 18–26 may be supplied to the mixing tank 14 through a hopper 28. It will be appreciated that the dispensing system 27 may deposit the water 24 and the admixture 26 directly into the mixing tank 14 or through the hopper 28.

The system 10 includes a computer system 30 to monitor the status of the mixer 12, the dispensing of the water 24 and the admixture 26 and perform other functions as will become apparent. The computer system 30 includes an input device such as a keyboard 32, a display monitor 34 which provides input questions and prompts to the user, and an output device such as a printer 36. An IBM compatible computer with an Intel '286 processor or equivalent thereof is sufficient to perform the functions of the computer system 30. Interconnected between the input device 32, the display monitor 34 and the printer 36 is a processor 40 which includes the necessary read-only memory, look-up tables and other associated hardware and software for controlling the operation of the system 10. As seen in FIG. 1, the processor 40 is connected to various components within the system 10 as designated by the capital letter designations A–H. Of course, other connections may be made to the processor 40 to enhance operation of the system 10. It will be appreciated that most data is entered into the processor 40 by the batchman or dispatcher who organizes the comings and goings of the fleet of concrete mixing trucks. It will also be appreciated that the computer system 30 may be located on site at the concrete mixing facility and connected directly to components in the dispensing system 27, or the computer system 30 may be remotely linked to components in the dispensing system 27 through modems and phone lines or by direct wire links. In one embodiment, the computer system 30 is capable of simultaneously controlling up to six dispensing systems 27 at each of up to sixty plant sites.

An admixture piping system 42, which is a component of the dispensing system 27, ensures that the correct amount of admixture 26 is received by the mixer or mixing tank 14. The admixture piping system 42 includes a pump 44 connected to the admixture supply 26. The pump 44 is driven by a motor 46 to initiate the flow of the admixture 26. Operation of the pump 44 is controlled by the processor 40. Serially connected to the pump 44 are a pair of flow meters 48 and 50 which measure the flow of the admixture 26 through the admixture piping system 42. Both meters 48 and 50 are connected to the processor 40 to communicate the amount of admixture 26 delivered to the mixing tank 14. Those skilled in the art will appreciate that the two meters 48 and 50 are employed to verify and check the operation of the other and to communicate to the processor 40 any problem associated therewith. An electric valve 52 is connected to the meter 50 and is operatively controlled by the processor 40. The electric valve 52. opens and closes as directed by the processor 40 depending upon the amount of admixture delivered to the mixing tank 14 according to the measurements acquired by the meters 48 and 50. Of course, other valves controllable by a processor may be used in the admixture piping system 42. A check valve 54 is connected to the electric valve 52 to prevent any admixture or other material or fluids from inadvertently entering the admixture supply 26. After the check valve 54, the admixture piping system 42 directs the flow of admixture into the mixing tank 14 or the hopper 28. Interconnected between the components of the admixture piping system are unions 56 which allow for the components of the admixture piping system 42 to be removed therefrom for servicing or replacement.

A water piping system 60, which is a component of the dispensing system 27, ensures that the correct amount of water 24 is received by the mixing tank 14. It will be appreciated that the supply of water is provided by the local water company or if necessary by a separate water reservoir. If supplied by a reservoir, the water piping system 60 will include the appropriate pumps and the like to transfer the water from the reservoir to the mixing tank 14. The admixture piping system 60 includes a flow meter 62 which measures the flow of the water through the water piping system 60. The meter 62 is connected to the processor 40 to communicate the amount of water 24 sent to the mixing tank 14. An electric valve 64 is connected to the meter 62 and is operatively controlled by the processor 40. The electric valve 64 opens and closes as directed by the processor 40 depending upon the amount of water needed for the mixing tank 14 and the measurement acquired by the meter 62. A check valve 66 is connected to the electric valve 64 to prevent any water, other material or fluids from inadvertently entering the water supply 24. After the check valve 66, the water piping system 60 directs the flow of water into the mixing tank 14 or the hopper 28. Interconnected between the components of the water piping system are unions 56 which allow for the components of the water piping system 60 to be removed therefrom for servicing or replacement.

A keypad or driver input device 70, which is another component of the dispensing system 27, is connected to the processor 40 and receives the truck number 15 entered by the driver. When appropriate, the driver may also enter in the keypad 70 the temperature of the concrete as the truck 12 is being returned to service or as it is returning from a job site with unused concrete 17. It will be appreciated that this information may be inputted directly to the processor 40 through the input device 32 by the batchman.

A flashing status light 72, which is yet another component of the dispensing system 27, is connected to the processor 40 and is proximally located near the keypad 70 in a position viewable to the driver of the truck 12. Once the correct amount of admixture 26 and water 24 has been calculated by the processor 40 and the driver has positioned the truck to receive the same, the light 72 flashes or illuminates in a predetermined manner to indicate that the dispensing system 27 is dispensing the admixture 26 and/or water 24. The light 72 is changed to another predetermined state indicating completion of the dispensing cycle for the truck. Of course, other visual or audible alarms may be employed to indicate completion of the dispensing cycle.

Figure 2A:
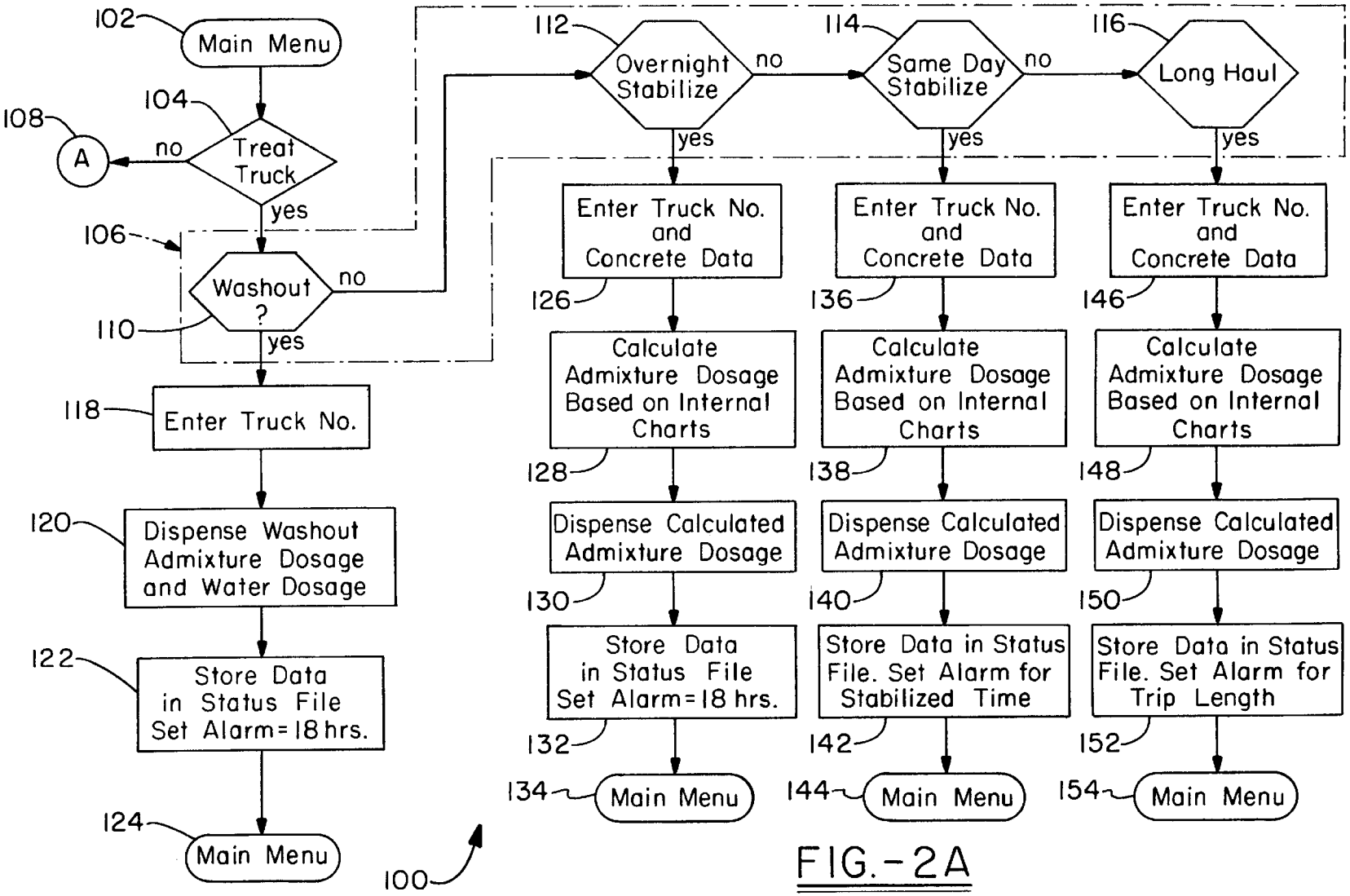
FIGS. 2A and 2B illustrate a top level flow chart employed by the present invention.
Figure 2B:
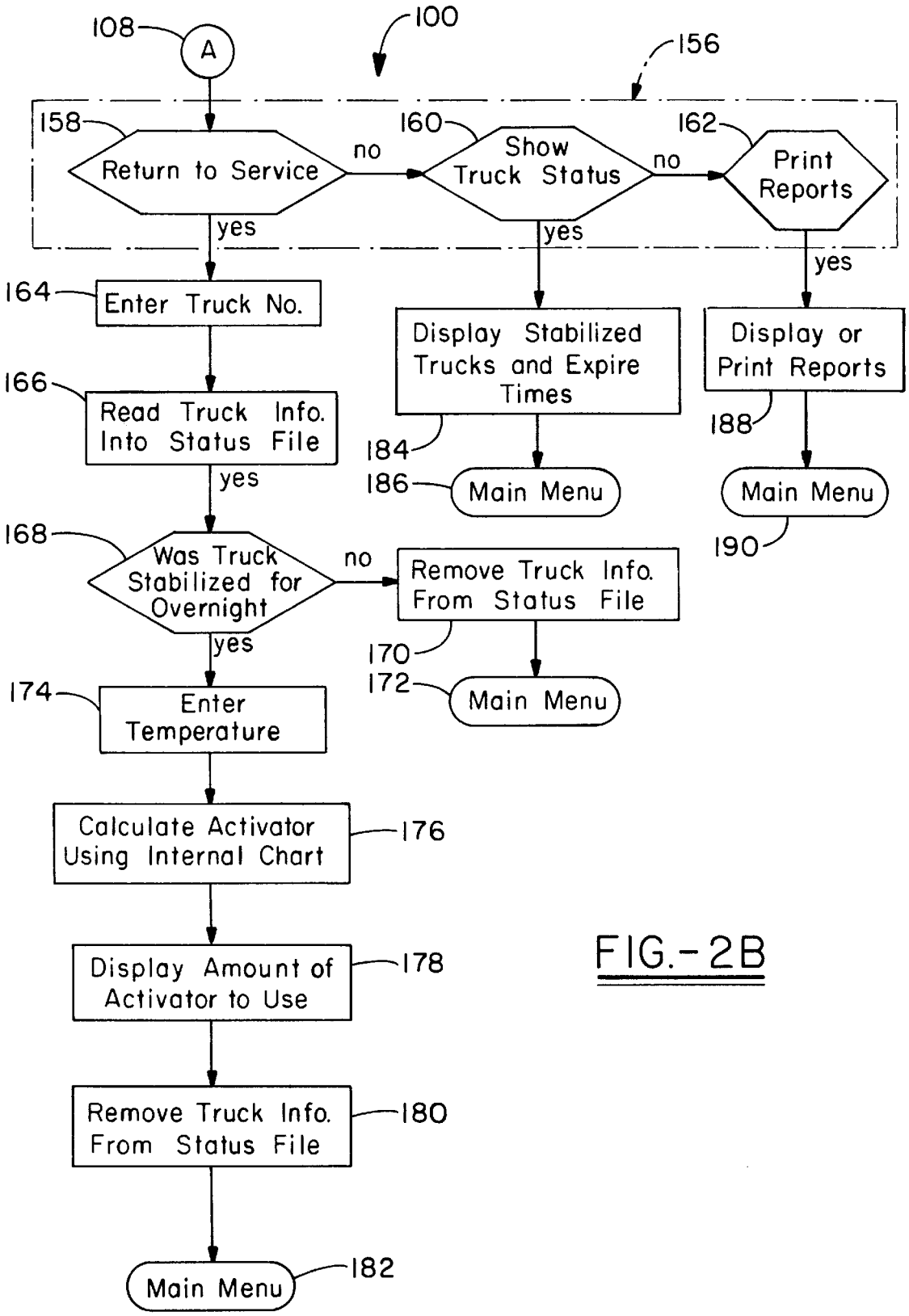

Referring now to FIGS. 2A and 2B it can be seen that a process for implementing the system 10 is designated generally by the numeral 100 and is examplified for convenience wit respect to mixing trucks. As those skilled in the art will appreciate, the process 100 is implemented by way of software or firmware contained within the processor 40. As such, the process 100 inquires from the user various particulars regarding the content status of the concrete mixing trucks, including their volume content, the amount of concrete required for a particular job, the distance to the job site and other pertinent factors for determining the correct amount of admixture 26 and other materials to be mixed in the mixing tank 14. Based upon the answers to the prompts provided by the process 100, the processor 40 calculates the correct amount of admixture and the like, and controls the operation of the admixture piping system 42, the water piping system 60 and other features of the system 10. As will be illustrated in further detail below, the primary consideration of the process is whether the concrete mixing truck is returning from a job or going to a job site. Based upon the answers input by the user (batchman and/or driver), the processor 40 implements a subroutine that selects an appropriate data table, calculates the amount of admixture and water, and generates signals to control the dispensing of the same.

Referring now to FIG. 2A, it can be seen that the process 100 is initiated at the main menu, at step 102, which is displayed by the display monitor 34. At step 104, the process 100 inquires as to whether the concrete mixing truck 12 is to be treated with an admixture or not. It will be appreciated that the process 100 may be used to determine an amount of any admixture for a batch of concrete, although in the exemplified preferred embodiment the process 100 is employed to determine the correct amount of stabilizer admixture. If at step 104 it is determined that the truck 12 is to be treated, the process continues at step 106, otherwise the process 100 continues at step 108. Generally, step 106 provides the batchman with four options or treatments that can be performed on the contents of the truck 12. The batchman selects one of the options based upon the amount of unused concrete in the mixer or truck and the batchman's best estimate of when the unused concrete in the mixer will be used again or when the truck will be returned to service. The options within step 106 are set forth as a washout option 110, an overnight stabilization option 112, a same day stabilization option 114 and a long haul option 116. Each of these options will be discussed in turn.

The washout option 110 is employed when the truck 12 is returned from a job site empty. It will be appreciated; however, that the interior of the mixing tank 14 is coated with cement, fine aggregate and coarse aggregate. In the past this residue was washed out using anywhere between 150 to 300 gallons of water which was then disposed of in a landfill or the like. By adding a stabilizer with the washout water, the wash water then may be reused in subsequent mixes of concrete. The washout option continues at step 118 where either the driver or the batchman enters the truck number at the appropriate input device 32 or 70. The driver positions the mixing tank 14 underneath the outlets of the dispensing system 27 or alternatively the outlets are moved toward the mixing tank. At step 120, the proper amounts of the admixture 26 and the water 24 are dispensed. During the dispensing step 120, the status light 72 flashes until the dispensing cycle is complete. Upon completion of the dispensing cycle the driver places the truck in a holding area. At step 122, the processor 40 stores the data or content status regarding the washed-out truck in a memory status file and sets an alarm for a predetermined time period which in the preferred embodiment is about eighteen hours. If the alarm is annunciated, the batchman must take some type of corrective action on the washed-out truck. This action may be another wash-out cycle or the return of the truck to service as will be discussed in step 108. After the truck data is stored, step 124 returns the process 100 to the main menu.

The overnight stabilization option 112 is selected when a truck 12 is returned to the mixing site with a portion of unused concrete and the batchman does not foresee sending the truck to a job site that day. At step 126, the truck number is entered into the processor 40 and the batchman enters data or content status of the unused concrete. This data or content status includes, but is not limited to, the mix design including the previous admixtures used, the initial batch time of the returned concrete, the quantity of the concrete (cubic yards/cubic meters), the amount of water needed to return the concrete to the desired slump, the temperature of the concrete and the total amount of cementitious material (cement, fly ash or slag) per cubic unit. Based upon this input information, the processor 40, at step 128, calculates the correct amount of admixture, in this case stabilizer, from a predetermined chart or look-up table contained within the memory of the processor 40. The driver positions the mixing tank 14 underneath the outlets of the dispensing system 27 or alternatively the outlets are moved toward the mixing tank. At step 130 the calculated amounts of admixture 26 and water 24 are dispensed. During the dispensing step 130, the status light 72 flashes until the dispensing cycle is complete. Upon completion of the dispensing cycle, the driver places the truck in a holding area. At step 132, the processor 40 stores data regarding the truck in a memory status file and sets an alarm for a predetermined time period which in the preferred embodiment is about eighteen hours. If the alarm is annunciated, the batchman must take some type of corrective action on the stabilized truck. This action may be another dose of stabilizer or other admixture, or the return of the truck to service. After the truck data is stored, step 134 returns the process 100 to the main menu.

The same day stabilization option 114 is selected when a truck 12 is returned to the mixing site with a portion of unused concrete and the batchman foresees sending the truck to another job site that day. At step 136, the truck number is entered into the processor 40 and the batchman enters data or content status of the unused concrete. This data or content status includes, but is not limited to, the mix design including the previous admixtures used, the initial batch time of the returned concrete, the quantity of the concrete (cubic yards/cubic meters), the amount of water needed to return the concrete to the desired slump, the temperature of the concrete and the total amount of cementitious material (cement, fly ash or slag) per cubic unit. Based upon this input information, the processor 40, at step 138, calculates the correct amount of admixture, in this case stabilizer, from a predetermined chart or look-up table contained within the memory of the processor 40. The driver positions the mixing tank 14 underneath the outlets of the dispensing system 27 or alternatively the outlets are moved toward the mixing tank. At step 140 the calculated amounts of admixture 26 and water 24 are dispensed. During the dispensing step 140, the status light 72 flashes until the dispensing cycle is complete. Upon completion of the dispensing cycle, the driver places the truck in a holding area. At step 142, the processor 40 stores data regarding the truck in a memory status file and sets an alarm for a predetermined time period depending upon how much stabalizer was added. In the preferred embodiment this time period may be between about one-half hour to about four hours. If the alarm is annunciated, the batchman must take some type of corrective action on the stabilized truck. This action may be another dose of stabilizer or other admixture, or the return of the truck to service. After the truck data is stored, step 144 returns the process 100 to the main menu.

The long haul stabilization option 116 is selected when a truck 12 is being sent to a job site an extended distance from the mixing site. At step 146, the truck number is entered into the processor 40 and the batchman enters data or the content status of concrete to be mixed. This data or content status includes, but is not limited to, the mix design including other admixtures used, the quantity of the concrete (cubic yards/cubic meters), the temperature of the concrete, the total amount of cementitious material (cement, fly ash or slag) per cubic unit and the estimated time to the job site. Based upon this input information, the processor 40, at step 148, calculates the correct amount of admixture, in this case stabilizer, from a predetermined chart or look-up table contained within the memory of the processor 40. The driver positions the mixing tank 14 underneath the outlets of the dispensing system 27 or alternatively the outlets are moved toward the mixing tank. At step 146 the calculated amount of admixture 26 is dispensed. During the dispensing step 150, the status light 72 flashes until the dispensing cycle is complete. Upon completion of the dispensing cycle, the driver delivers the concrete to the job site. At step 152, the processor 40 stores data regarding the truck in a memory status file and sets an alarm for the estimated time period selected by the batchman in the input step 150. If the alarm is annunciated, the driver must take some type of corrective action to maintain the concrete in its stabilized condition. This action may be dispensing another dose of stabilizer or other admixture. After the truck data is stored, step 154 returns the process 100 to the main menu.

It will be appreciated that all of the options 110–116 in step 106 employ their own specific charts or look-up tables depending upon the data entered by the batchman and/or driver. Another input feature of the input steps 126, 136 and 146 is that a percentage underdrive or overdrive value may be applied to the amount of admixture added. As such, if after using the process 100 for a while the batchman determines that the dosages of admixture are not performing the desired function on the concrete for the desired length of time or that the dosage functions on the concrete for too long a period of time, the software provider may instruct the processor 40 to overdrive (increase) or underdrive (decrease) the dosage a specified percentage. The overdrive/underdrive adjustments may also compensate for reactive characteristics that the admixture may have with a particular cement and for temperature and humidity variations at the mixing site. This allows the software provider to compensate dosage values for factors not considered in the data charts or look-up tables.

Returning to step 108, where it is determined that a concrete mixing truck is not to be treated, the process 100 proceeds to step 156. Step 156 includes a return to service option 158, a truck status option 160 and a print report option 162. Each of these options will be discussed in turn.

The return to service option 158 is employed when a previously treated or stabilized truck is selected for return to service. The batchman or driver enters the truck number into the processor at step 164. At step 166, the processor 40 accesses the stored data file for the designated truck and determines whether the truck was stabilized overnight (option 112) or not. If the truck was not stabilized overnight, meaning that the truck is either empty or was washed-out, the stored data in the status file is deleted at step 170 and the process 100 is returned to the main menu at step 172. Accordingly, the batchman may then select any option desired. If at step 168 it is determined that the truck was stabilized or treated overnight, the batchman will enter the temperature of the concrete in the truck at step 174. At step 176, the processor 40 uses the stored data file and the temperature value entered in step 174 to calculate the amount of activator or other admixture to be mixed with the concrete. At step 178, this calculated amount is displayed for appropriate action by the batchman or driver. After the activator is added to the unused concrete, the batchman may batch new concrete on top of the unused concrete. At step 180 the processor 40 deletes the truck information from the status file in memory and at step 182 the process 100 is returned to the main menu.

The truck status option 160 is selected whenever the batchman needs to know which mixer or trucks are partially loaded and/or which trucks have stabilization periods that are about to expire. Accordingly, at step 184 the stabilized mixer or trucks and their respective expiration times are displayed on the monitor 34. After this display, the process 100 is returned to the main menu at step 186. This option allows for the batchman to effectively monitor mixers or a fleet of trucks and more accurately dispatch trucks within the fleet, thus saving large quantities of unused concrete. The truck status can display any number of mixers or trucks located at any number of mixing sites. Of course, the truck status option 160 may be configured to sort the mixers or trucks in any predetermined hierarchy to facilitate selection thereof.

The report status option is selected by the batchman or mixing plant management to display or print any number of status reports or the like on the printer 36 at step 188. These reports may be used to see how much money is saved by stabilizing unused concrete, how many trucks have been washed-out, how many mixers or trucks have stabilized concrete and so on. At step 190, the process 100 is returned to the main menu.

Based upon the foregoing it can be seen that numerous advantages are realized by use of the admixture dispensing and concrete mixer monitoring system 10 and the related process 100. Primarily, the system 10 provides a comprehensive way to determine the correct amount of admixture to be used in each mixer or truck in a fleet of concrete mixing trucks. This system is more accurate in calculating the amount of admixture required and also ensures that the correct amount is dispensed into the mixing tank 14 of the concrete mixing truck 12. Moreover, the system 10 is capable of monitoring trucks at remote mixing plants and can control the operation of multiple dispensing systems 27 simultaneously. Use of the system 10 over extended periods of time will result in large savings of unused concrete and the costs associated with the disposal of the same. Use of the system also eliminates the need for expensive and unreliable reclamation devices.

Thus it is demonstrated that the objects of the present invention are met. The examples listed above are for illustrative purposes only and the present invention is not to be limited to them. It is to be understood that other admixtures, fillers, cementitious compositions and the like can be dispensed according to the present invention, and thus, the dispensing of specific admixtures can be accomplished without departing from the spirit of the invention herein disclosed and described. Thus, the scope of the invention shall include all modifications and variations that may fall within the scope of the attached claims and equivalent embodiments.

What is claimed is:

1. A method for monitoring at least one concrete mixing truck and its contents, comprising the steps of:

determining a content status of at least one of a fleet of concrete mixing trucks wherein said content status is one of returning from a job site empty, returning from a job site with unused concrete, going to a job site and is currently empty, and going to a job site and currently contains unused concrete;

calculating a quantity of admixture, a quantity of water, and a quantity of other concrete ingredients depending upon the findings of said determining step; and storing the identity of the at least one concrete mixing truck and the quantity of admixture, the quantity of water, and the quantity of other concrete ingredients, which were calculated, wherein said steps of calculating and storing all occur in a processor.

2. The method according to claim 1 wherein if the at least one concrete mixing truck is returning from the job site and is empty, the method further includes the steps of:

depositing the calculated quantity of admixture and water in the at least one concrete mixing truck; and storing the fact that the quantity of admixture and quantity of water were deposited.

3. The method according to claim 1 wherein if the at least one concrete mixing truck is returning from a job site and contains unused concrete, the determining step further includes ascertaining the amount of unused concrete carried by a returned concrete mixing truck and the method further includes the steps of:

depositing the calculated quantity of admixture in the returned concrete mixing truck; and storing the fact that the quantity of admixture was deposited.

4. The method according to claim 3, wherein the determining step further comprises ascertaining the temperature of the unused concrete, and the calculating step further includes calculating the quantity of admixture based on the temperature of the unused concrete and the content status of the returned concrete truck.

5. The method according to claim 1 wherein if the at least one concrete mixing truck is going to a job site and is empty, the method further includes the steps of:

depositing the quantity of admixture, the quantity of water and the quantity of other concrete ingredients determined in the calculating step in the at least one concrete mixing truck; and storing the fact that the quantity of admixture, the quantity of water, and the quantity of other concrete ingredients were deposited.

6. The method according to claim 5, wherein the determining step further comprises ascertaining the temperature of a mixture of the quantity of water and the quantity of other concrete ingredients prior to depositing the quantity of admixture, and the calculating step further includes calculating the quantity of admixture based on the temperature of the mixture and the content status of the at least one concrete truck.

7. The method according to claim 1 wherein if the at least one concrete mixing truck is going to a job site and contains unused concrete, the determining step further includes ascertaining the amount of unused concrete carried by a returned concrete mixing truck and the method further includes the steps of:

depositing the calculated quantity of admixture, water and other concrete ingredients in the at least one concrete mixing truck; and storing the fact that the quantity of admixture, quantity of water, and quantity of other concrete ingredients were deposited.

8. The method according to claim 7, wherein the determining step further comprises ascertaining the temperature of the unused concrete, and the calculating step further includes calculating the quantity of admixture based on the temperature of the unused concrete and the content status of the at least one concrete truck.

9. The method according to claim 1 wherein if a concrete mixing truck is needed for a job site, the method further includes the steps of:

retrieving from a processor memory the identity of trucks stored in memory;

selecting from said processor memory one of the concrete mixing trucks for use at the job site based upon predetermined selection criteria; and calculating a quantity of admixture to be included with the selected concrete mixing truck.

10. The method according to claim 9, wherein the determining step further comprises ascertaining the temperature of the unused concrete in the concrete mixing truck that currently contains unused concrete, and the calculating step further includes calculating the quantity of admixture based on the temperature of the unused concrete and the content status of the at least one concrete truck.

11. The method according to claim 1, wherein the calculating step for calculating the quantity of admixture to be dispensed in the concrete mixing truck comprises the steps of:

storing in look-up tables data for determining admixture quantities to be dispensed;

storing in memory input questions to be answered by a user;

processing by the processor the answers provided by the user to select which stored look-up table to access to determine admixture quantities; and calculating a quantity of admixture from said selected look-up table and the answers provided by the user.

12. The method according to claim 11, further comprising the step of storing in memory a status of each concrete mixing truck in the fleet of concrete mixing trucks and an amount of unused concrete, if any, contained in each concrete mixing truck.

13. The method according to claim 12, further comprising the step of displaying the status of the concrete mixing trucks available for use and their respective contents.

14. The method according to claim 12, further comprising the step of scheduling by the processor which concrete mixing truck should be sent to a job site next based upon answers to the input questions and the status of each truck.

15. The method according to claim 12, further comprising the step of retrieving from memory the admixture content of the unused concrete carried by a selected concrete mixing truck, whereby the retrieved admixture content and the answers to the input questions are used by the processor to select one of said stored look-up tables.

16. The method according to claim 15, further comprising the step of adjusting by a percentage the calculated admixture quantity based upon input from the user.

17. The method according to claim 16, further comprising the step of generating a signal to dispense the calculated quantity of admixture based upon input from the user.

18. The method according to claim 11, further comprising the step of adjusting by a percentage the calculated admixture quantity based upon input from the user.

19. The method according to claim 18, further comprising the step of generating a signal to dispense the calculated quantity of admixture based upon input from the user.

20. The method according to claim 11, further comprising the step of outputting selected reports based upon input from the user.

21. The method according to claim 11, further comprising the step of generating a signal to dispense the calculated quantity of admixture based upon input from the user.

* * * * *